US007137515B1

(12) United States Patent
Lawson et al.

(10) Patent No.: US 7,137,515 B1
(45) Date of Patent: Nov. 21, 2006

(54) EXTENDABLE STORAGE RACK

(76) Inventors: Stephen Lawson, 1947 Ocean Park Road, Surrey, British Columbia (CA) V4A 3M2; Christopher Isfeld, 13331 Sylvester Road RR3, Mission, British Columbia (CA) V2V 4J1

( * ) Notice: Subject to any disclaimer, the term of this patent is extended or adjusted under 35 U.S.C. 154(b) by 0 days.

(21) Appl. No.: 11/184,137

(22) Filed: Jul. 20, 2005

(51) Int. Cl.
*A47F 5/08* (2006.01)

(52) U.S. Cl. ..... 211/85.3; 211/94.04; 312/334.4; 312/334.5

(58) Field of Classification Search ..... 211/85.3, 211/94.01, 182, 105.1, 105.3, 96; 312/334.5, 312/334.7, 334.11, 334.4, 334.17, 322; 248/250
See application file for complete search history.

(56) References Cited

U.S. PATENT DOCUMENTS 2,499,159 A * 2/1950 Pestyner ..... 211/96
2,683,890 A * 7/1954 Rosenbaum ..... 16/87.4 R
2,683,891 A * 7/1954 Rosenbaum ..... 16/87.4 R
2,715,966 A * 8/1955 Tieck ..... 211/94.01
3,027,015 A * 3/1962 Miller ..... 211/85.3
3,954,182 A * 5/1976 McEvers ..... 211/94.01
4,569,450 A * 2/1986 Dillingham ..... 211/96
4,581,788 A * 4/1986 Baumann ..... 16/93 D
5,472,272 A * 12/1995 Hoffman ..... 312/334.11
5,960,967 A * 10/1999 Neil ..... 211/94.01
6,644,483 B1 11/2003 Lai
6,679,392 B1 1/2004 Costa
6,698,603 B1 * 3/2004 Lawson et al. ..... 211/94.01
6,719,158 B1 4/2004 Goldberg
6,871,749 B1 3/2005 Bostik et al.
2003/0192845 A1 * 10/2003 Lawson et al. ..... 211/94.01

* cited by examiner

*Primary Examiner*—Richard E. Chilcot, Jr.
*Assistant Examiner*—Lindsay M. Maguire
(74) *Attorney, Agent, or Firm*—Frederick Kraufman

(57) ABSTRACT

An extendable storage rack comprises an elongated horizontal housing of relatively small thickness, provided laterally, at one side, with a continuous surface, and at an opposite side, with a longitudinal passage extending along its length. At its bottom it is provided with a longitudinal channel, commensurate in length with the longitudinal passage. A slide with ball bearings, of the type used for drawers, is located almost entirely in the longitudinal passage, wherein the slide is firmly fastened with one part to the longitudinal passage, while with another, opposite part, is adapted to be fastened to a panel. Several devices for hanging and storing apparel articles are guided in and pending from the longitudinal channel.

3 Claims, 4 Drawing Sheets

EXTENDABLE STORAGE RACK

I. BACKGROUND OF THE INVENTION

1. Field of the Invention

The present invention relates in general to storage racks and, more particularly, to an extendable storage rack adapted for storing apparel articles such as neckties, scarves, etc.

2. Description of the Prior Art

Extendable racks developed to fit inside wardrobes are already known. Among others, attempts have been made in the past by the same inventors as the present ones to develop an improved extendable rack. Thus, for example, U.S. Patent Application Publication No. 2003/0192845, published Oct. 16, 2003 under the title "Extendable rack" describes an extendable rack adapted for retaining one or more cantilever support(s) and for attaching to a panel via a slide. The extendable rack comprises an elongated body incorporating, at one side, a longitudinal channel for retaining the cantilever support(s), and, at another, opposite side, a longitudinal passage adaptable for locating, almost entirely, the slide and for firmly securing one side of it. This extendable rack is considered to have shortcomings. First, the use of cantilever support(s) suspended at one side of the extendable rack requires more space. Second, due to the remote position of cantilever support(s) with stored apparel with respect to an attachment of the slide to a panel, a distance between the former and the latter is relatively greater. As a result, the bending moment acting on the attachment is significant.

II. SUMMARY OF THE INVENTION

In view of the mentioned shortcomings, there is a need to develop an extendable rack that eliminates, or, at least alleviates those concerns.

Broadly stating, the extendable storage rack, according to the present invention, comprises

- an elongated horizontal housing of relatively small thickness, provided laterally,
  - at one side, with a continuous surface; and
  - an opposite side, with a longitudinal passage extending along its length; and at its bottom
  - with a longitudinal channel, commensurate in length with the longitudinal passage. A slide with ball bearings, of the type used for drawers, is located almost entirely in the longitudinal passage, wherein the slide is firmly fastened with one part to the longitudinal passage, while with another, opposite part, is adapted to be fastened to a panel. Several devices for hanging and storing apparel articles are guided in and are pendent from the longitudinal channel.

In one aspect of the present invention, the continuous surface has at one side a curvilinear surface with a cross-section similar to an a inverse C, while at an opposite side has the longitudinal passage delimited by a vertically positioned web and by a pair of shelves extending horizontally at the extremities of the latter. The longitudinal passage has in general a U-shape contour, which can be specifically defined as a U-shape contour rotated at 90°.

In another aspect of the present invention, use is made of a pair of caps, one for each end of the elongated horizontal housing. Each one of the pair of caps has a lateral base and a centering element projecting perpendicularly from the lateral base. A central rectangular window is formed in the lateral base and a recessed zone follows at a relatively small distance a contour of the central rectangular window. The centering element is inserted into a space limited by an interior face of the continuous surface and the vertically positioned web. A stopper, usually of plastics, is inserted in the recessed zone for preventing a movement in one direction of the elongated horizontal housing, past an end of that part of the slide that is secured to a panel.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF PREFERRED EMBODIMENTS

The accompanying drawings illustrate a preferred embodiment of an extendable storage rack 10. At the onset, it is to be agreed, those terms, such as "top", "bottom", "vertical", "horizontal", "upwardly", "downwardly" and "outwardly" are conventionally employed in the present specification with reference to the normal position in which extendable storage rack 10 would be used.

Figure 1:
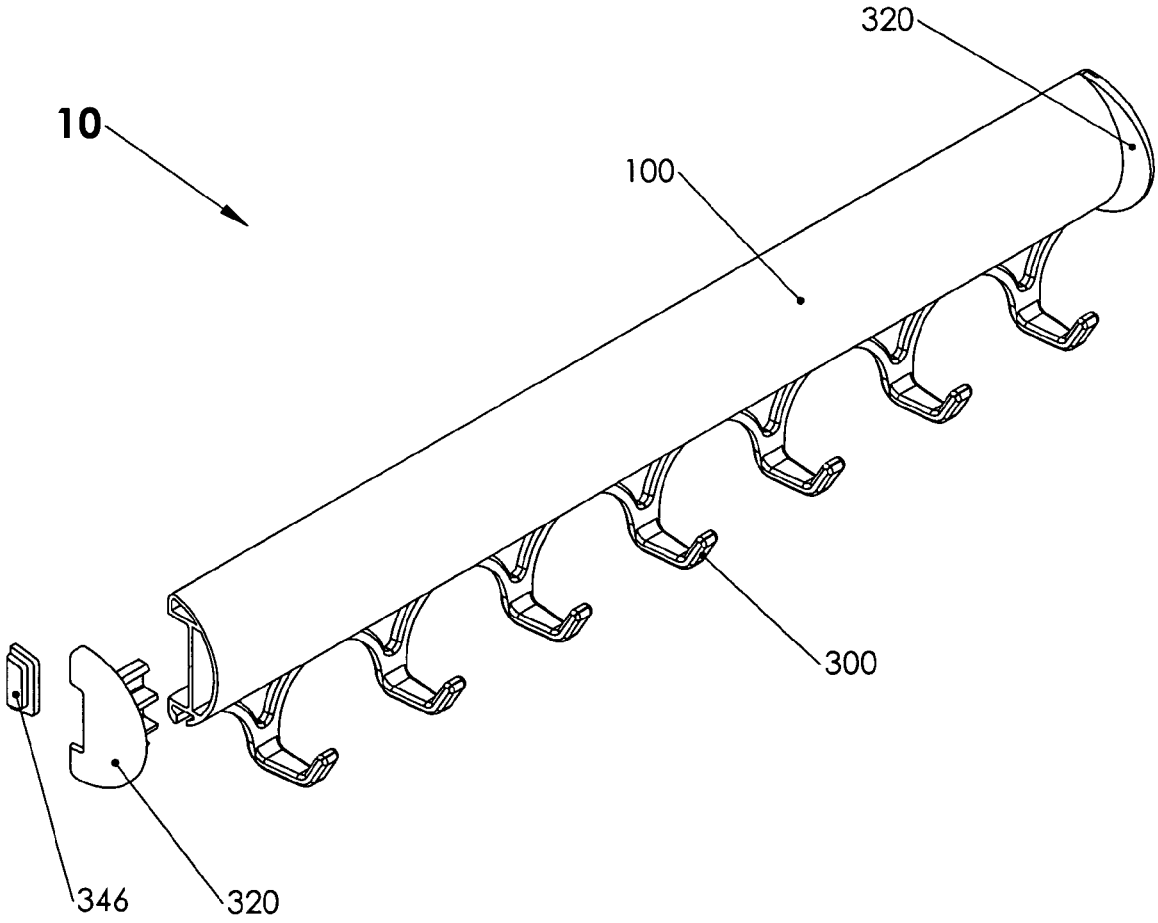
FIG. 1 depicts a partly exploded assembly of extendable storage rack of the present invention.
Figure 2:
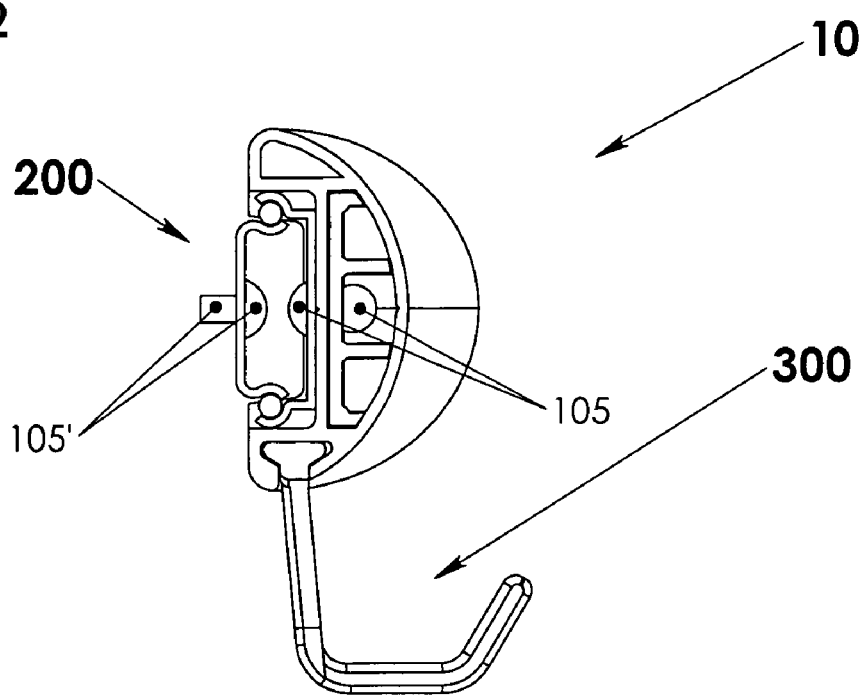
FIG. 2 depicts a cross-section, along a vertical plan, of FIG. 1.

In general, see FIGS. 1 and 2, extendable storage rack 10 comprises an elongated horizontal housing 100, of relatively small thickness, provided laterally,

- at one side, with a continuous curvilinear surface 102 having a cross-section similar to an inverse C; and
- an opposite side, with a longitudinal passage 104 extending along its length; and at its bottom, with a longitudinal channel 106 commensurate in length with longitudinal passage 104.

A slide 200 is adaptable to be located almost entirely in longitudinal passage 104, wherein is secured, via rivets 105, with one part, while with another, opposite part is adapted to be attached, via bolts 105', to a panel (not shown). Thus, elongated horizontal housing 100 is glidingly assembled on slide 200.

Several successive hanger members 300, guided in longitudinal channel 106, are kept pending from the latter.

Figure 3:
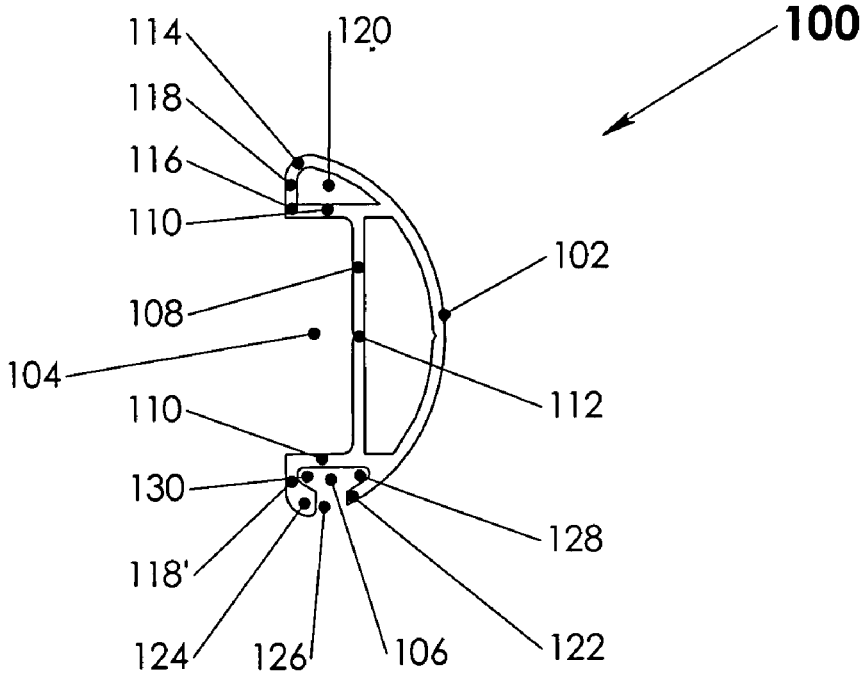
FIG. 3 depicts a lateral view of the elongated horizontal housing of this invention.

Referring now in detail to FIGS. 2 and 3, elongated horizontal housing 100, usually of extruded aluminum, has laterally, at one side, its continuous curvilinear surface 102 defined by the cross-section similar to an inverse C; also laterally, but at the opposite side, longitudinal passage 104 is delimited by a web 108, vertically positioned, and by a pair of shelves 110 extending horizontally at the extremities of the latter. Thus, longitudinal passage 106 has in general a U-shape contour, which can be specifically defined as a U-shape contour, rotated at 90°. Web 108 is provided with several perforations 112 intended for attaching, via rivets 105, slide 200 and other components of extendable storage rack 10.

At the top, an uppermost end 114 of continuous curvilinear surface 102 is joined to one of the pair of shelves 110 that is at the top, respectively an outermost end 116 of the latter, by a vertical segment 118. Thus, a closed niche 120 is formed.

At the bottom, continuous curvilinear surface 102 has an interruption 122, while a vertical segment 118', which starts from one of the pair of shelves 110 that is at the bottom, ends with a protuberance 124 deflected towards continuous curvilinear surface 102. Thus, a gap 126 is formed between protuberance 124 and interruption 122 of continuous curvilinear surface 102.

Between the latter and one of the pair of shelves 110 that is at the bottom, a first wedge-shaped recess 128 is formed, while between vertical segment 118' and protuberance 124 a second wedge-shaped recess 130 is formed. The purpose of first and second wedge-shaped recesses 128 and 130 will be explained later in the present disclosure.

Extendable storage rack 10, according to the present invention, incorporates several successive hanger members 300 of identical structure and purpose, or several hanger members 300 structurally different, to accommodate various purposes.

Figure 4:
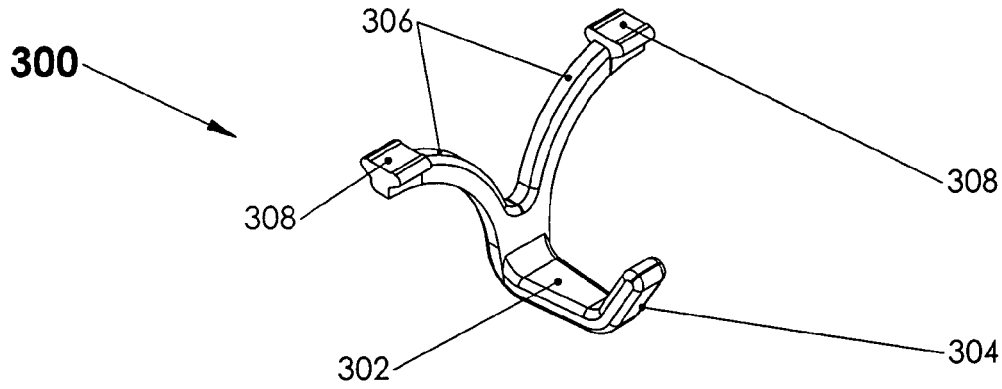
FIG. 4 is a perspective view of a hanger member of general purpose, designed accordingly to the present invention.

A hanger member of general purpose 300, depicted in FIG. 4, comprises a horizontal support segment 302, which extends perpendicularly to and outwardly from a vertical plane passing through longitudinal channel 106 and, then, changes into an inclined stopping segment 304. Horizontal support segment 302, at an end opposite to inclined, stopping element 304, extends upwardly, along the vertical plane passing through longitudinal channel 106, as a pair of arcuate, divergent arms 306.

A thickness of each one of the pair of arcuate, divergent arms 306 is so chosen as to allow an easy insertion into and movement along longitudinal channel 106. When reaching an interior of longitudinal channel 106, each end of the pair of arcuate, divergent arms 306 is provided with a guiding member 308 to compliment and glidingly fit to an upper contour of the former, which contour is delimited by one of the pair of shelves 110 that is at the bottom and first and second wedge-shaped recesses 128 and 130.

Figure 5:
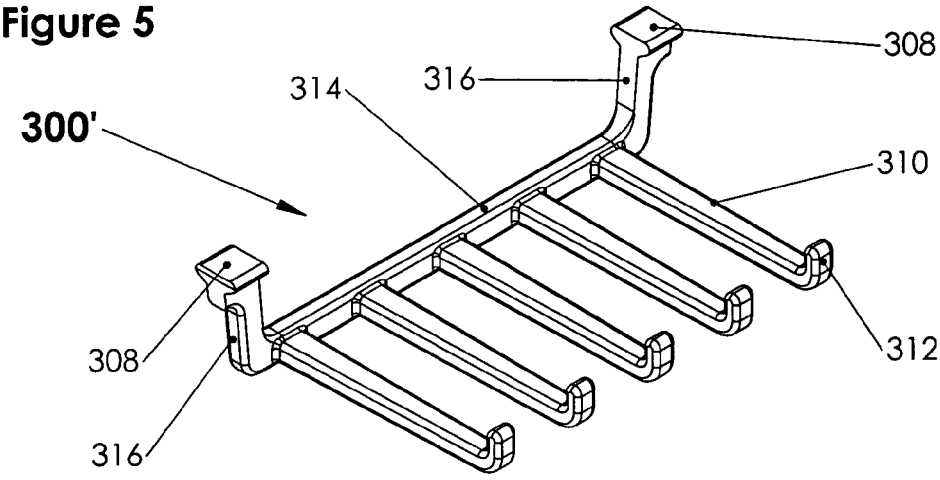
FIG. 5 is a perspective view of a neckties hanger member, designed, as well, accordingly to the present invention.

A neckties hanger member 300', depicted in FIG. 5, incorporates several horizontal prongs 310, each of the latter extending perpendicularly and outwardly from the vertical plane passing through longitudinal channel 106 and, then, changing into a stopping, inclined segment 312. Horizontal prongs 310, at their ends opposite to stopping, inclined segments 312, are joined together perpendicularly by a connecting bar 314 coplanar with the vertical plane passing through longitudinal channel 106. A vertical rod 316 extends upwardly from each extremity of connecting bar 314. When reaching the interior of longitudinal channel 106, each end of vertical rod 316 is provided with guiding member 308 to compliment and glidingly fit to the upper contour of the former, which contour is delimited by one of the pair of shelves 110, which is at the bottom, and first and second wedge-shaped recesses 128 and 130.

Figure 6:
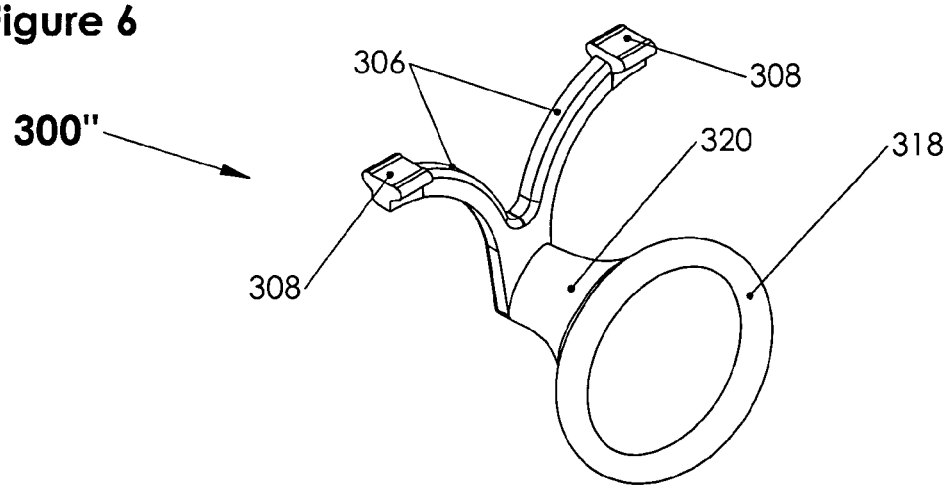
FIG. 6 is a perspective view of a scarf hanger member, designed, as well, accordingly to the present invention.
Figure 7:
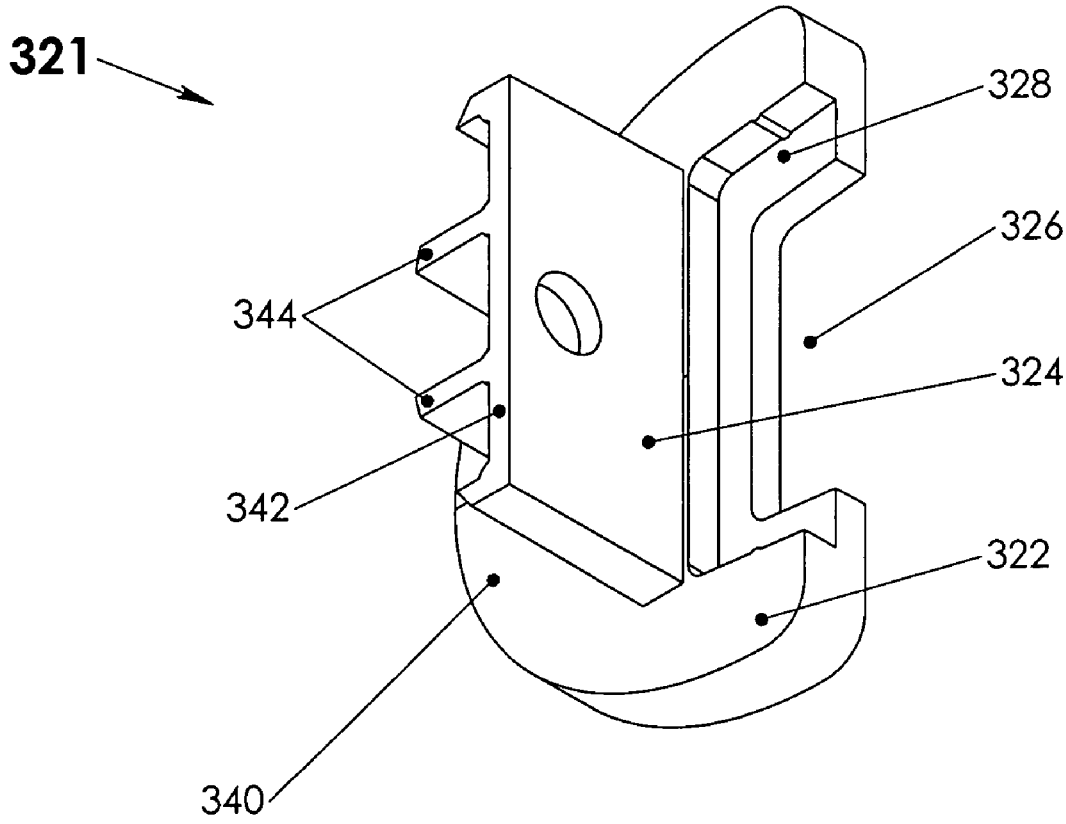
FIG. 7 is a perspective view of a cap inserted into each end of the elongated horizontal housing.

A scarf hanger member 300", depicted in FIG. 6, incorporates a ring 318, spaced from the vertical plane passing through longitudinal channel 106 and disposed in a plane perpendicular to the latter plane, this perpendicular plane being inclined approximately at 30° from a vertical plane. A pair of arcuate, divergent arms 306 provided with guiding members 308, as used in hanger member of general purpose 300, is interconnected through a joint 320 to ring 318. Joint 320 and ring 318 are coplanar.

It is obvious, that various structures intended to be employed as hanger members of general use and as neckties and scarf hanger members can be envisaged without departing from the present invention concept, described in the foregoing disclosure. For example, one or more guiding members, a continuous guiding member, etc. can be contemplated.

Elongated horizontal housing 100 is provided at each end with a cap 321. Cap 321 has a lateral base 322 and a centering element 324 projecting perpendicularly from lateral base. Lateral base 322 is, generally, semicircular and has a central rectangular window 326 opened towards a back of elongated horizontal housing 100. A recessed zone 328 following at a relatively small distance a contour of central rectangular window 326 is formed in lateral base 322. Basically, the latter covers continuous curvilinear surface 102, web 108 and the pair of shelves 110. Furthermore, lateral base 322 has a prominent zone 340 projecting outwardly, beyond continuous curvilinear surface 102. Prominent zone 340 is used for grasping and displacing elongated horizontal housing 100 with respect to that part of slide 200 that is attached to a panel. Centering element 324 is inserted into the space limited by an interior face of continuous curvilinear surface 102 and web 108. For this purpose it has a flat member 342 which, at one side, is intended to be tangent to web 108; another side is provided with two pairs of spacers 344 for contacting the interior face of continuous curvilinear surface 102. Flat member 342 is provided with a hole for securing through a rivet (not shown) to one of the several perforations 112.

A stopper 346 (see FIG. 1), usually of plastics, is inserted in recessed zone 328 of one of the caps 321 for preventing a movement in one direction of elongated horizontal housing 100, past an end of that part of slide 200 adapted to be secured to the panel.

As required, a detailed embodiment of the present invention is disclosed herein; however, it is to be understood that the disclosed embodiment is merely exemplary for this invention, which may be embodied in various forms. Therefore, specific structural and functional details disclosed therein are not to be interpreted as limiting, but merely as a basis for teaching one skilled in the art to variously employ the present invention in virtually any appropriately detailed structure.

We claim:

1. An expendable storage rack comprising in combination an elongated horizontal housing provided laterally, at one side, with a continuous surface; and at an opposite side, extending along its length, with a longitudinal passage; and at its bottom with a longitudinal channel, commensurate in length with said longitudinal passage;

means for sliding, located substantially in said longitudinal passage;

means for securing one side of said means for sliding to one part to said longitudinal passage of said elongated horizontal housing, the latter being provided for this purpose with several perforations;

means for attachment, adapted to join another, opposite side of said means for sliding to a panel; and means for hanging and storing apparel articles, guided in and pending from said longitudinal channel.

2. The extendable storage rack, as defined in claim 1, wherein said continuous surface has at one side a curvilinear surface with a cross-section similar to an a inverse C, while at an opposite side has said longitudinal passage delimited by a vertically positioned web and by a pair of shelves extending horizontally at the extremities of the latter, thus, said longitudinal passage having, essentially, a U-shape contour rotated at 90°.

3. The extendable storage rack, as defined in claim 2, further comprising a pair of caps, one for each end of said elongated horizontal housing, each one of said pair of caps having a lateral base and a centering element projecting perpendicularly from said lateral base, a central rectangular window being formed in said lateral base and a recessed zone closely following a contour of said central rectangular window, said centering element being inserted into a space limited by an interior face of said continuous surface and said vertically positioned web; a stopper being inserted in said recessed zone for preventing a movement in one direction of said elongated horizontal housing, past an end of that part of said slide that is adapted to be secured to said panel.

* * * * *